United States Patent [19]

Gautier

[11] 4,411,123

[45] Oct. 25, 1983

[54] PACKAGING APPARATUS

[75] Inventor: Raoul L. A. Gautier, Belmont sur Vair, France

[73] Assignee: Societe Generale des Eaux Minerales de Vittel, Vittel, France

[21] Appl. No.: 210,364

[22] Filed: Nov. 25, 1980

[30] Foreign Application Priority Data

Sep. 6, 1980 [FR] France ..... 80 13039

[51] Int. Cl.[3] ..... B65B 9/08

[52] U.S. Cl. ..... 53/550; 53/562; 53/568

[58] Field of Search ..... 53/562, 568, 550; 141/166

[56] References Cited

U.S. PATENT DOCUMENTS

| | | | |
|---|---|---|---|
| 2,269,532 | 1/1942 | Howard | 53/562 X |
| 2,649,674 | 8/1953 | Bartelt | 53/562 |
| 2,718,105 | 9/1955 | Ferguson | 53/562 |
| 3,045,403 | 7/1962 | Mitchell | 53/562 X |
| 3,381,446 | 5/1968 | Marchand | 53/562 |
| 3,821,873 | 7/1974 | Benner | 53/562 X |
| 3,866,394 | 2/1975 | Masai | 53/562 |
| 3,975,888 | 8/1976 | Jones | 53/562 X |
| 4,232,504 | 11/1980 | Dieterlan | 53/562 X |
| 4,305,240 | 12/1981 | Grevich | 53/562 X |

FOREIGN PATENT DOCUMENTS

| | | | |
|---|---|---|---|
| 309741 | 11/1955 | Switzerland | 53/562 |

*Primary Examiner*—John Sipos

*Attorney, Agent, or Firm*—Mason, Fenwick & Lawrence

[57] ABSTRACT

Packaging apparatus is described for forming a series of containers from an elongated strip of film and for disposing materials, illustratively a liquid, into each of the containers. The packaging apparatus comprises a supply of the film, a mechanism for withdrawing the film from the supply and for advancing the film along a path, and a mechanism disposed at a first station adjacent the path for shaping the film into the series of containers. A material injection mechanism is disposed at a second station along said path downstream of the first station for injecting a measured quantity of liquid at periodic intervals into a single one of the series of containers as it is brought one at a time to the second station. A mechanism is provided for imparting a relatively stationary relationship between each container of the series and the material injecting mechanism, thereby permitting the injection of materials into each of the containers before they are severed from each other.

13 Claims, 24 Drawing Figures

FIG. 4
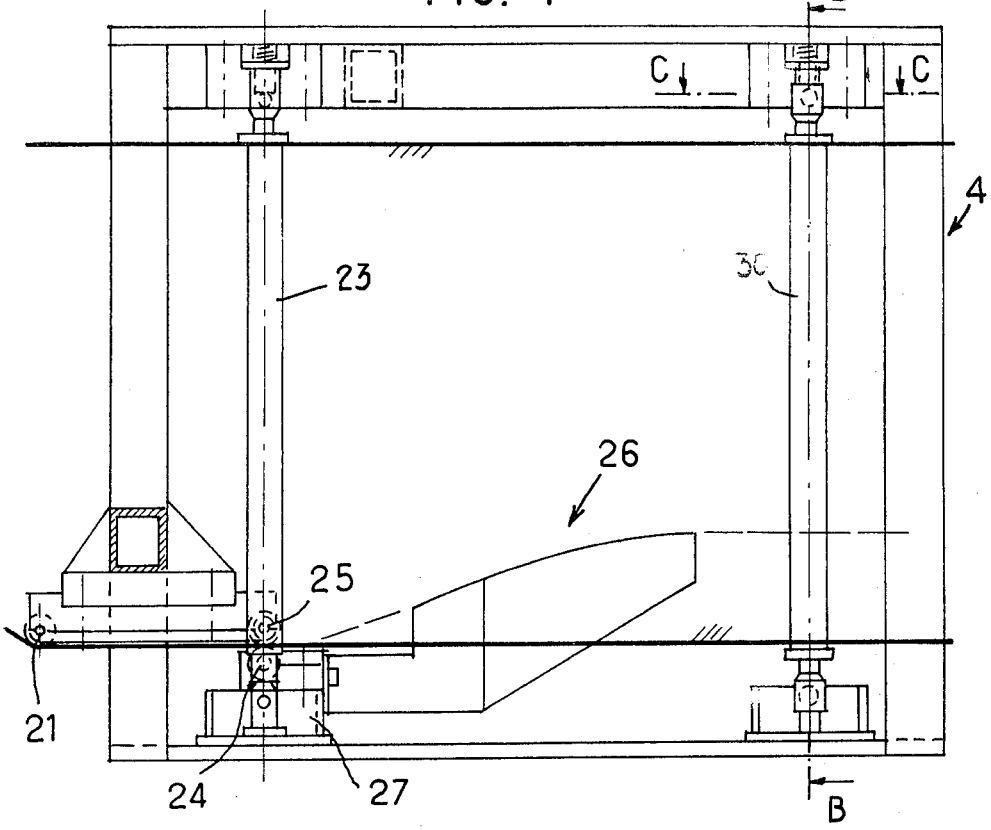
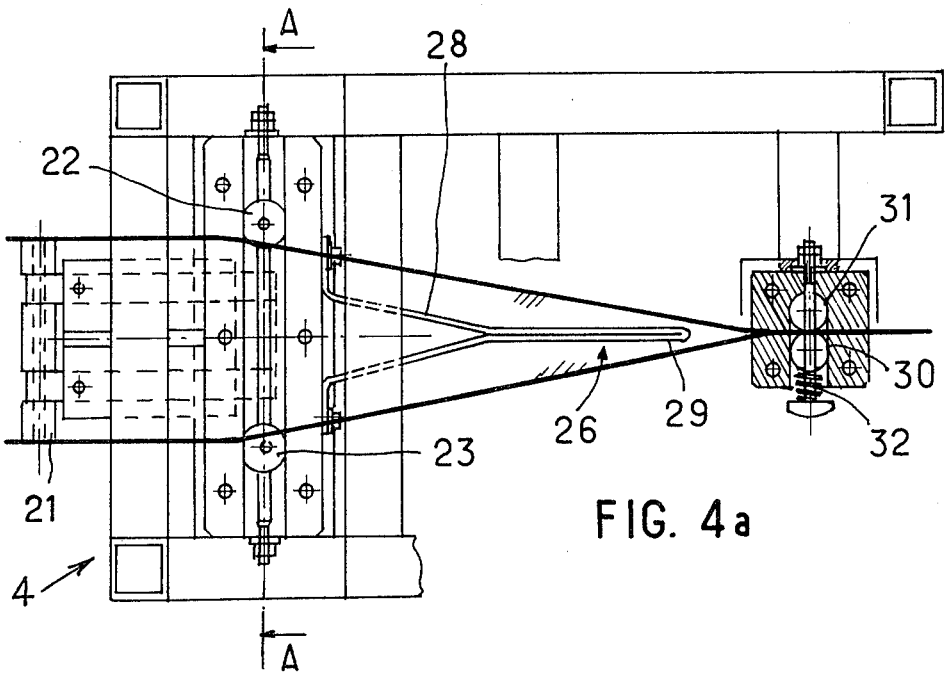
FIG. 4a

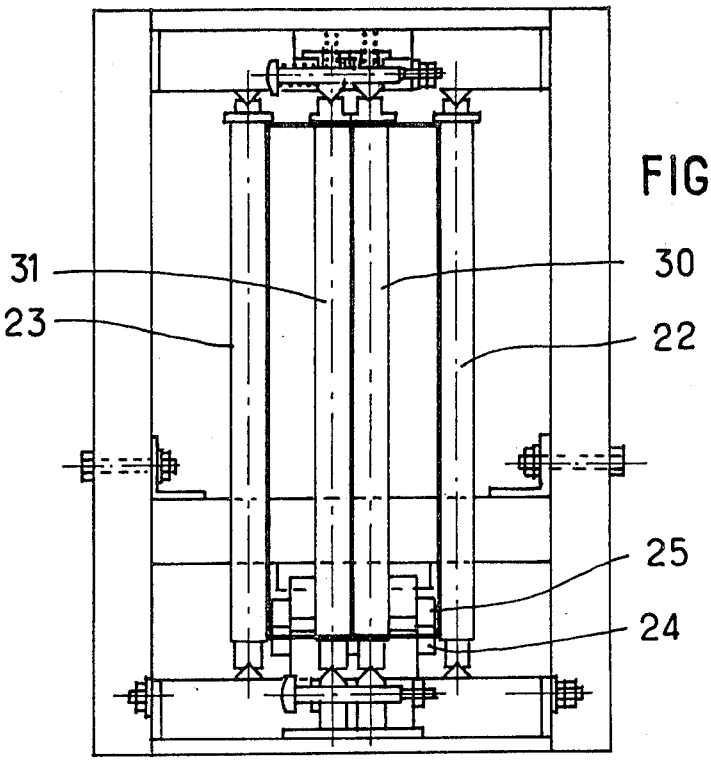
FIG. 4b
FIG. 4c
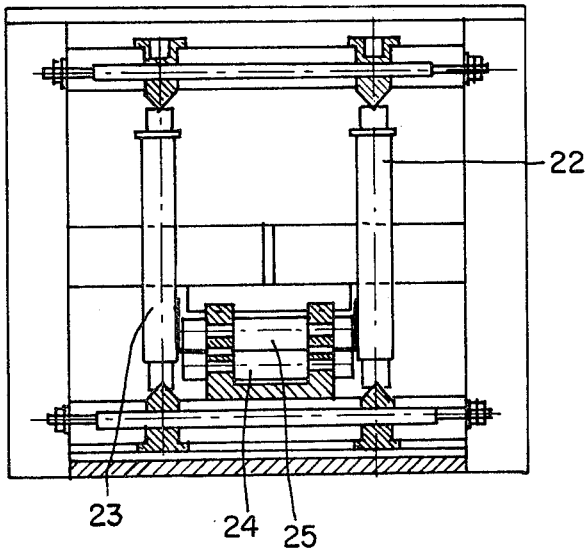

FIG. 7
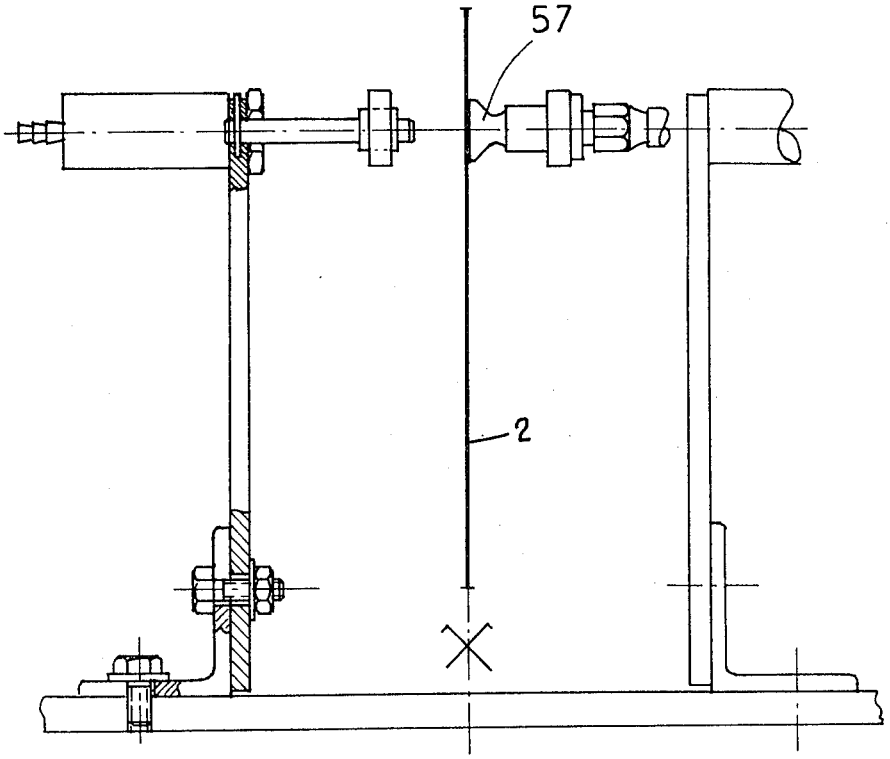
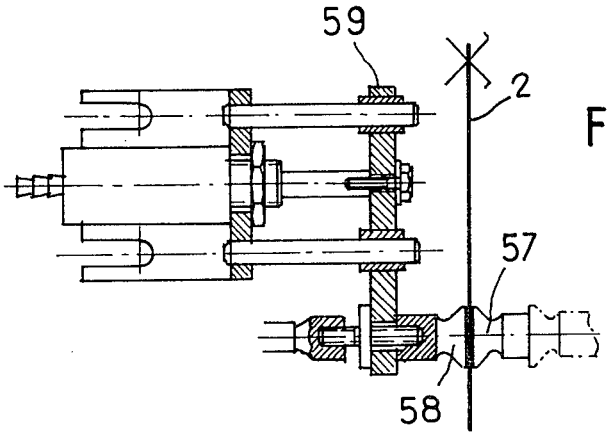
FIG. 7a

PACKAGING APPARATUS

DESCRIPTION

TECHNICAL FIELD

The present invention relates to apparatus for packaging materials, e.g., liquids, into containers or strings of containers made of flexible synthetic material formed from a supply of synthetic film.

BACKGROUND OF THE PRIOR ART

The containers which can be produced by the packaging apparatus of this invention are of the type described, for example, in French Patents and Patent Applications Nos. 75-18358, 78-04233 corresponding to U.S. Pat. No. 4,216,639, and 80-02187 corresponding to U.S. patent application Ser. No. 187,561 filed Sept. 15, 1980, now U.S. Pat. No. 4,372,192.

Reference will be made hereinafter to the packaging of edible liquids, but the invention can also be applied to the packaging of any liquid material in general.

BRIEF SUMMARY OF THE INVENTION

Packaging apparatus according to the teachings of this invention comprises:

(a) a synthetic film supply assembly
(b) a film unwinding device
(c) a plurality of stations for forming the film into a container
(d) a container filling and packaging unit
(e) a film feed device.

BRIEF DESCRIPTION OF THE DRAWINGS

The invention will be understood better with the aid of the following description with reference to the attached drawings.

FIG. 4 shows an elevation of the folding device;

FIG. 4*a* is a plan view of the device shown in FIG. 4;

FIG. 4*b* is a sectional view taken along line B—B of FIG. 4;

FIG. 4*c* is a sectional view taken along line A—A of FIG. 4*a;*

FIG. 4*d* is a sectional view taken along line C—C of FIG. 4;

FIG. 7 shows an elevational view of the suction nozzle device for spreading the walls of the containers;

FIG. 7*a* is a plan view of the spreading device of FIG. 7;

DESCRIPTION OF THE PREFERRED EMBODIMENT

Figure 1:
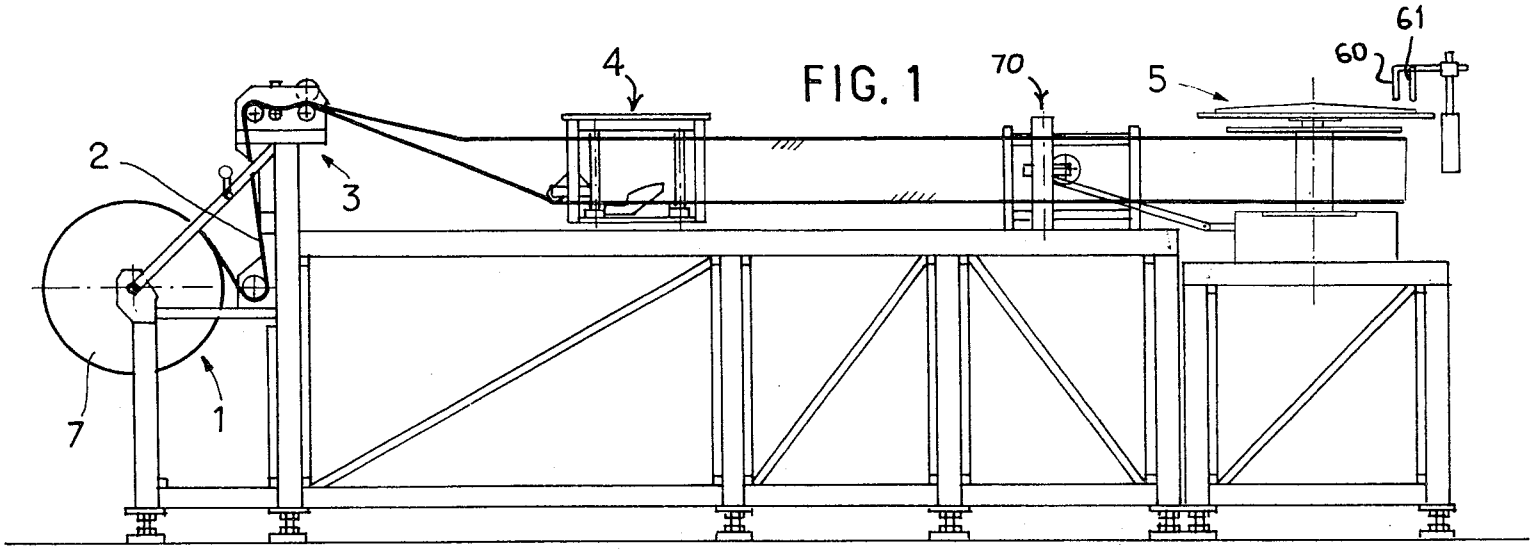
FIG. 1 shows an elevation view of the various stations of packaging apparatus according to this invention.

The packaging apparatus shown in FIG. 1 is supplied with a film 2 drawn from a reel 7. The following are thus shown in succession:

(i) the synthetic film 2 feed assembly 1
(ii) the film unwinding station 3
(iii) the station 4 for shaping or folding incremental lengths of the film 2 into a plurality of containers
(iv) the feed claw assembly 70
(v) the container filling unit 5
(vi) the filled container closing station 6.

Figure 2:
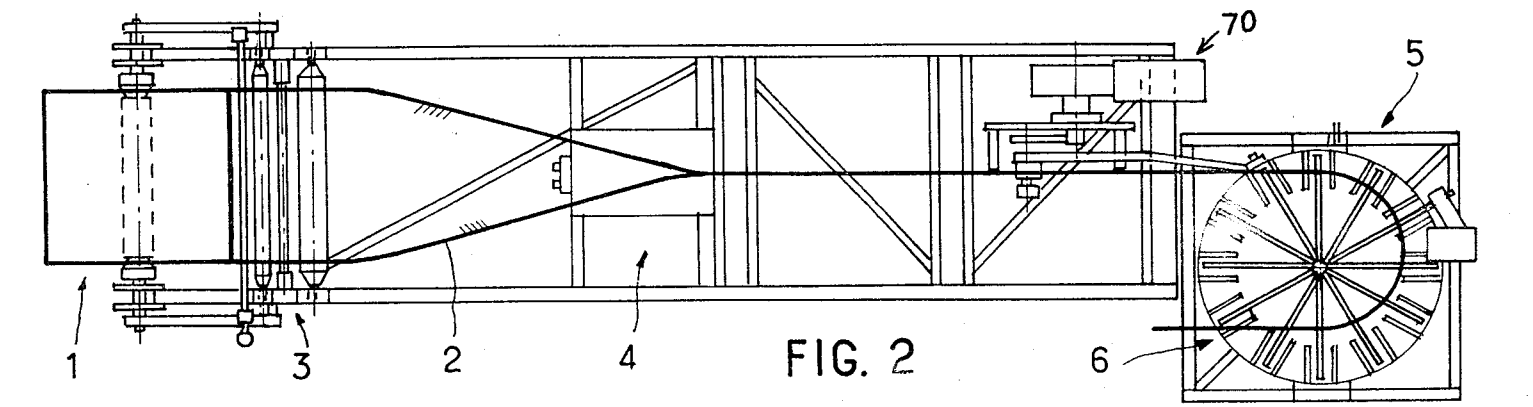
FIG. 2 is a plan view of the apparatus shown in FIG. 1.

Each of the elements in this packaging apparatus will now be described in detail. The film 2 comes from the reel 7 of standard film. The reel 7 shown in FIGS. 1 and 2 is mounted on an axle which is supported at its two ends by two bearings which will act, in a manner known per se, as support, and as axial and transverse centering for the film 2. At least one of these bearings will be supplied with a brake system which avoids the need for unwinding at a speed faster than the desired speed during the advance of the film 2.

Figure 3:
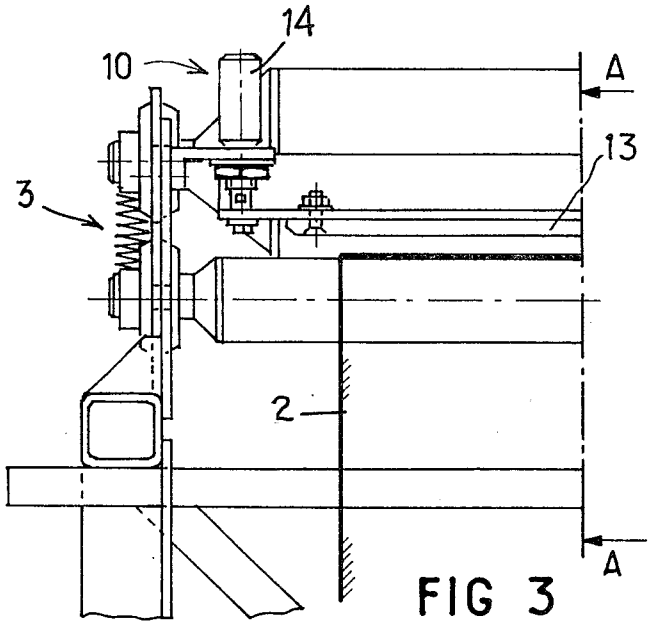
FIG. 3 is a face view of the device for unwinding the film.
Figure 3A:
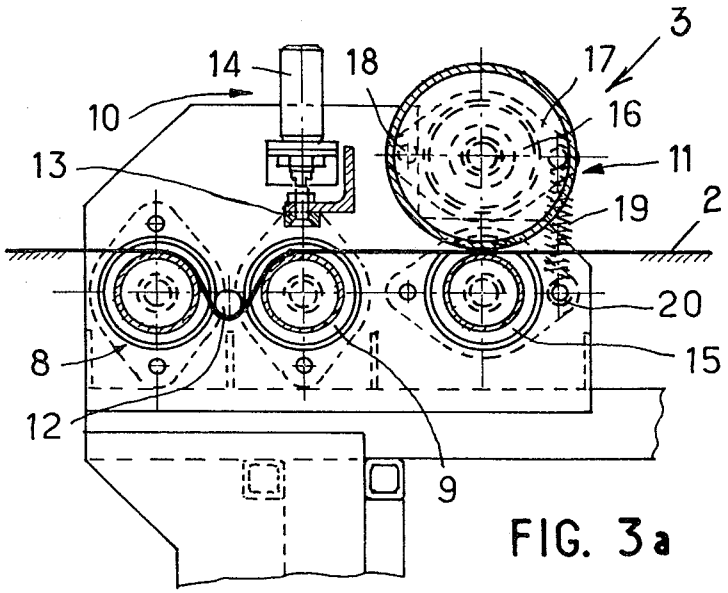
FIG. 3*a* is a sectional view taken along line A—A of FIG. 3.
Figure 3B:
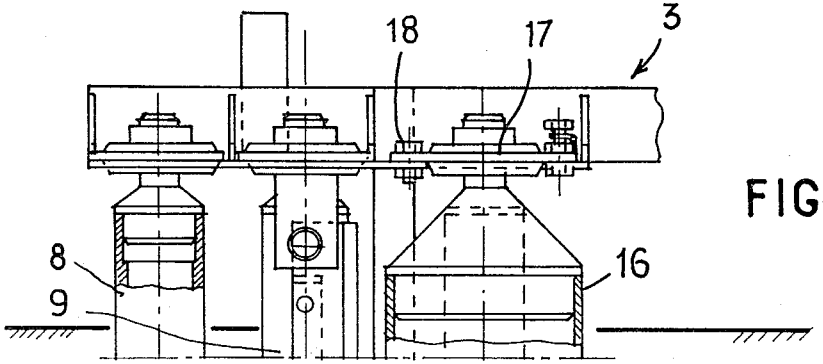
FIG. 3*b* is a partial, plan view of the unwinding device shown in FIG. 3.

Reference will now be made to FIGS. 3, 3*a*, and 3*b*. The advance of the film 2 is effected by periodic or continuous driving of the film 2. Two points for driving the film 2 will be arranged in the packaging apparatus for this purpose. The first film driving point will be arranged exactly at the position of the unwinding device 3. The second film driving point will be arranged downstream in the packaging apparatus.

The unwinding station 3 comprises, in succession, a return roller 8 for guiding the film 2 from the winding reel 7, a roller 9 connected to a brake 10, a guiding device 11 so that the film 2 will remain flat as it leaves the unwinding station 3.

A film feed system constituted essentially by a roller 12 controlled by a jack is arranged between the roller 8 and the brake assembly 10.

If, for example, substantially horizontal initial unwinding of the film 2 is desired after the first return roller 8, although it can also be vertical, the roller 12 is intermittently moved along a vertical path between a low position in contact with the film 2 and a high position remote from the film 2, by a mechanism (not shown) well known in the art. As the film 2 is wound beneath the roller 12 before passing on to the roller 9, the downward shifting of the roller 12 to its low position causes the film 2 to unwind from the reel 7 at a given rate.

The brake 10 comprises a shoe 13 which can be disposed against the roller 9 under the action of a jack 14, thus halting the movement of the film 2.

Unwinding is effected in the following manner:

(i) the brake 10 is actuated to its locking position;

(ii) the roller 12 for rotating the reel 7 and thus for unwinding the film 2 is disposed to its low position (iii) the roller 12 is raised (iv) the brake 10 is unlocked (v) the film 2 is caused to advance by the action of the feed claw assembly 70 arranged downstream in the packaging apparatus.

The film 2 will advantageously be unwound from the reel 7 in a series of incremental lengths or steps, each shorter than the effective step so as to impose the optimum tension on the film 2. This unwinding operation is carried out at controlled times, that is to say when the various stations for acting on the film 2 or on the already formed containers come into operation.

Once the cycle has been completed, the film 2 is released at the position of the brake 10 and is gripped by the feed claw assembly 70 which causes the film to advance by one step. The second station, which is therefore a mobile station, subsequently returns to its initial position. In fact, the return will be made slightly upstream of the initial position so that, after the locking of the brake 10, it will thus come into the initial position only to provide tension on the film 2.

The unwinding phases for reciprocal operation of the machine has been described above, that is to say according to a repetitive sequence:

(a) work on the stopped film 2, (b) advance of the film 2 without intervention.

Continuous operation permitting work to be carried out without interrupting the movement of the film 2 can obviously be conceived. For this purpose, the work stations need only advance with the film 2 and then return to their initial position either by means of an alternating to and fro system or by a rotating system of the carousel type. These two solutions can also be combined so that only some of the stations are mobile and the others stationary.

A guiding device 11 is provided at the outlet of the unwinding station 3 to keep the film 2 flat as it leaves a guide roller 15. The film 2 passes over this roller 15 and is contacted by an upper roller 16, which is articulated by a lever 17 about an axle 18 disposed parallel to the large axle of the rollers 15 and 16. This roller 16 is constantly brought into contact with the roller 15 by a spring 19 having one end connected at a point 20 fixed relative to the frame of the machine and another end connected to the lever 17 supporting the roller 16.

Moreover, a second reel support (not shown) could be provided in alignment with the first reel, thus permitting a continuous feeding of the film 2 and preventing any discontinuity of the film supply when the film supply of the first reel 7 is exhausted. A work station (not shown), for example, may be provided for labeling the film 2 with special end of reel symbols which are sensed to actuate suitable welding or bonding means to connect the trailing end of the first reel 7 and the leading end of the second reel, thus permitting uninterrupted operation. A dating device indicating the date of packaging, which is a compulsory label for certain products in numerous countries, can also be included, for example, at this stage. As the film 2 exits this work station, it includes various labels which have to appear on the final packaging. A system, as is well known in the art, is provided for detecting film delay or an advance exceeding desired limits, and permits the timing of the film advance with the labels applying rate thus achieving the centering of the labels on the individual containers after they are welded and severed at subsequent stations.

A sterilization station (not shown) may be disposed downstream of the unwinding station for destroying the bacteria on the film 2. The film may be passed, for example, into a bath of hydrogen peroxide, wrung by passage between two pressing rollers and then dried by blowing treated, hot air thereon and/or by passing through a microwave cavity. The results obtained depend on various parameters such as dissolution, concentration, soaking time of the film and drying time.

The station 4 for folding the film 2 will now be described with reference to FIGS. 4, 4*a*, 4*b*, 4*c*, and 4*d*. The purpose of this station 4 is to shape a flat film 2 described as being horizontal in this case into a container whose bottom is folded into a W. In a first stage, the film 2 is shaped into a U with sharp edges and thus with a horizontal bottom portion and two vertical sides, and then a fold is formed in the horizontal bottom portion to obtain the desired W-shaped configuration. The assembly is finally pressed to form creases in the film 2. First, the film 2 is directed by a horizontal folding roller 21 from the unwinding station 3 and is then guided vertically by two vertically disposed recentering rollers 22, 23 which are arranged on opposite sides of the film 2. At this stage, the bottom of the film 2 is shaped with a flat bottom between a second horizontal roller 25 and a third external roller 24. The rollers 21, 22, 23, 24, 25 can be provided with depth or height regulating devices.

On exiting the rollers 24 and 25, the film 2, which now exhibits the shape of a U with marked angles, reaches a leading ramp 26 fixed on the frame 27. This ramp 26 includes a portion 28 shaped as a V, and a trailing portion 29 shaped as an upwardly projecting finger, which allows the formation of a fold in the boom of the U. Upon passing from the ramp 26, the film 2 is directed between two vertically disposed, folding rollers 30, 31 to allow the creasing of the folds. One of the rollers 30, 31 is pressed against the other by a pressing system 32.

Various operations, which are known per se, are then carried out on the film 2, which are, respectively:

welding by any known process such as, for example, induction, ultra-sound, high-frequency;

cutting or rather pre-cutting of each container.

Two methods are essentially known in this case, i.e., by the use of a blade with optionally heated edges or of a tool and counter-tool.

As indicated above, this entire first phase for shaping the container may be carried out horizontally or vertically. At this stage of manufacture, the film 2 is formed into a string of containers, each of which is open at its top.

The object of the next or second phase of manufacture, as will now be described, is to fill these containers and then to seal the containers. Several methods of manufacture are possible at this stage. The process can either be continued in a linear manner or by means of a rotating assembly in which the film 2 engages tangentially the assembly's edge as it is received from the folding station 4, after completing the aforedescribed first phase of container manufacture.

Figure 5A:
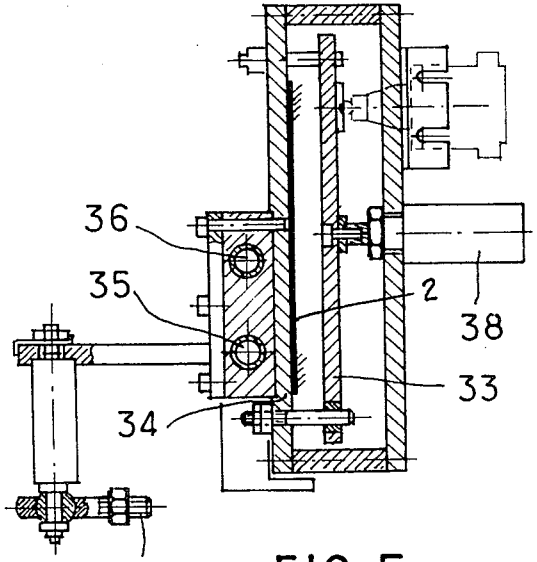
FIG. 5*a* is a front view of a partial section of the feed claw system of FIG. 5.
Figure 5:
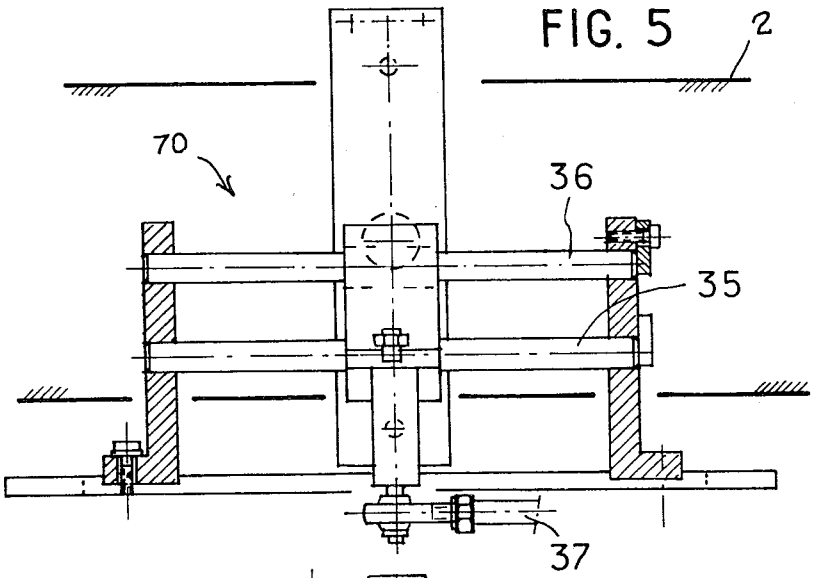
FIG. 5 shows an elevation of the feed claw system.
Figure 5B:
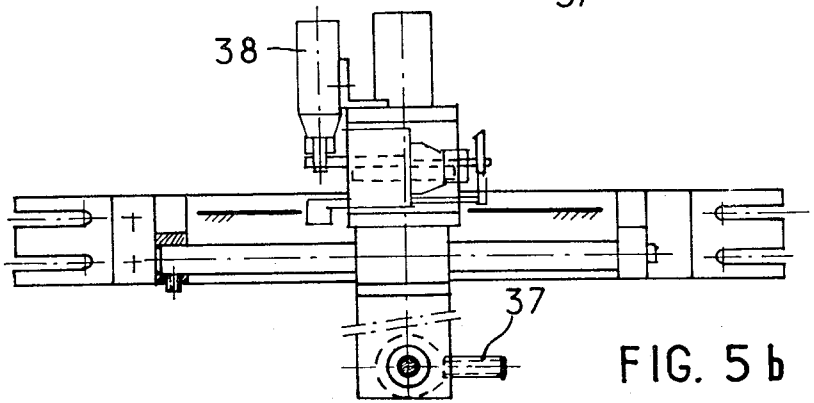
FIG. 5*b* is a plan view of the feed claw system shown in FIG. 5.

At the beginning of this second phase, the string of containers is received by the feed claw assembly 70 which has already been referred to above in the description of the unwinding of the film 2. This feed claw assembly 70 will be described with reference to FIGS. 5, 5*a*, 5*b*. The film 2 is taken between two flat jaws 33, 34 which are coupled with each other and perform a translational movement rectilinearly along two slides 35, 36. This rectilinear translation is effected by a connecting rod 37 and a mechanical device to which this connecting rod 37 is connected and which will be described below. One of the jaws 33 can also be moved relative to the other by the action of a jack 38. It is thus possible, due to the combination of the action of the jack 38 and of the connecting rod 37:

to hold the film 2 between the jaws 33 and 34,
to cause it to advance by one incremental step,
to release the film 2,
to bring the jaws 35 and 36 back to their starting position.

Figure 8:
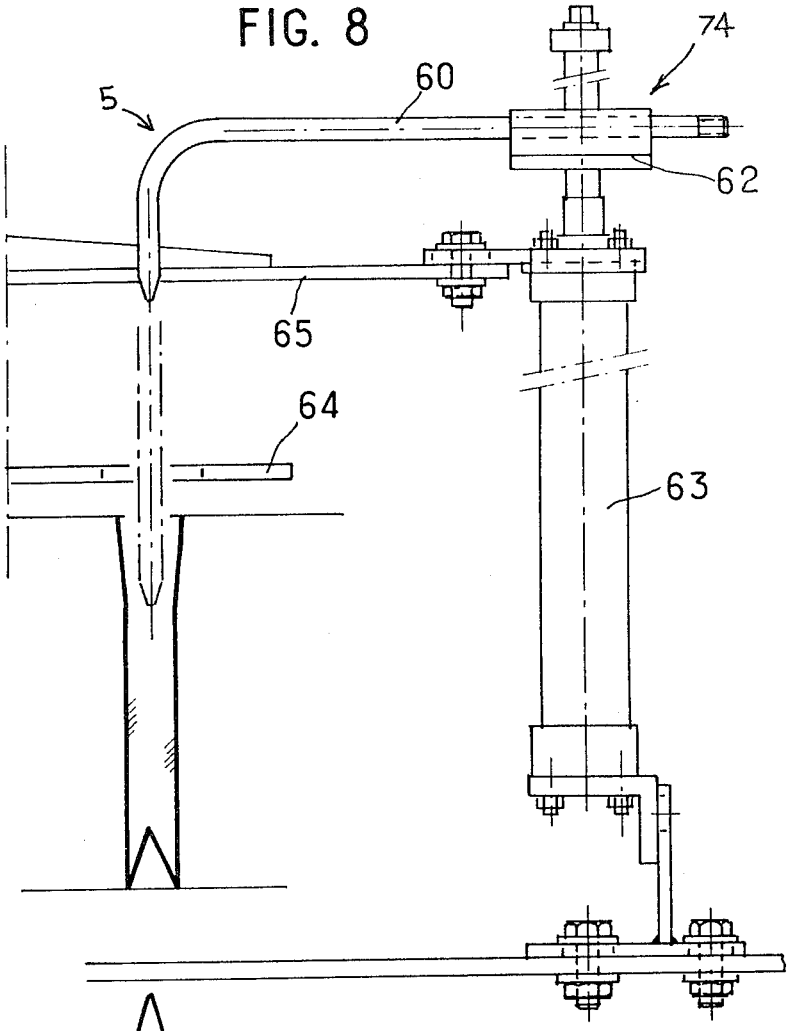
FIG. 8 shows an elevational view of the liquid injection station.
Figure 9:
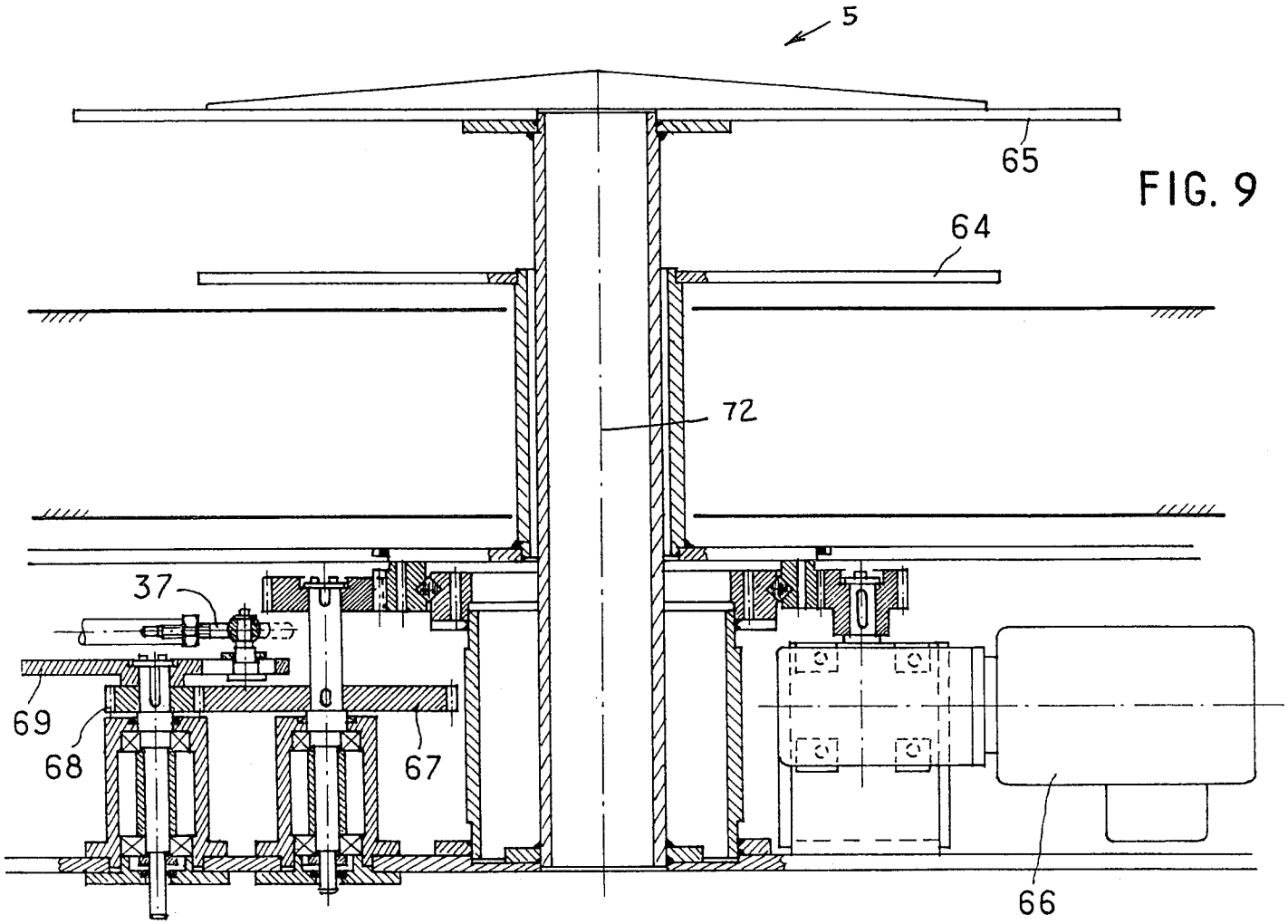
FIG. 9 shows an elevational view of the mechanical drive of the carousel shown in FIGS. 1 and 8, and of the feed claw system shown in FIG. 7.

The string of containers is advanced step by step to the container filing unit 5, as shown in FIGS. 1, 8 and 9. As shown in FIG. 9, a motor 66 rotatively drives a carousel 64, upon which are mounted about its periphery a plurality of pairs of claws 39 and 39'. Each of the preshaped containers is grasped individually by one of the pairs of claws 39 and 39' as it is brought to the unit 5. The claws 39 and 39' will be described in more detail with reference to FIGS. 6, 6*a*, 6*b*, 6*c*, 6*d*, and 6*e*. These claws 39 and 39' have a double function:

(i) each to support the containers individually
(ii) to permit the container to be opened at the top thus allowing it to be filled with liquid and to permit its top to be returned to a closed position before final welding.

Figure 6:
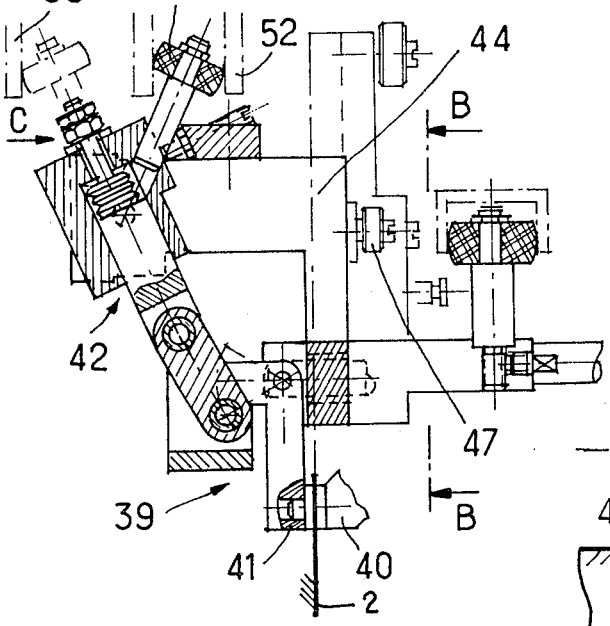
FIG. 6 shows a partial sectional elevation of a claw of the feed system for gripping the containers in order to fill them, in the clawing position.
Figure 6C:
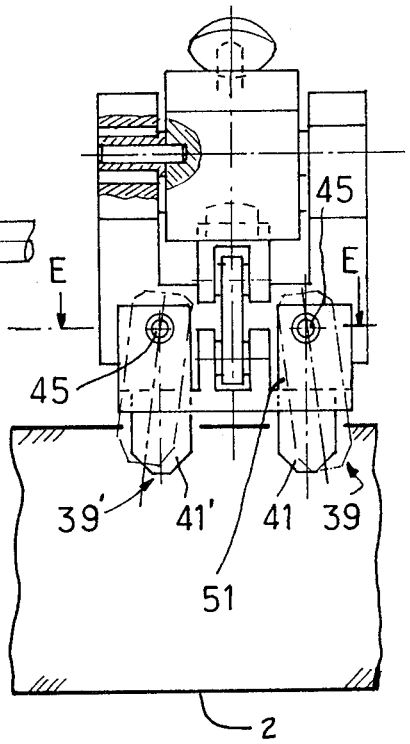
FIG. 6*c* is a sectional view taken along C of FIG. 6.
Figure 6A:
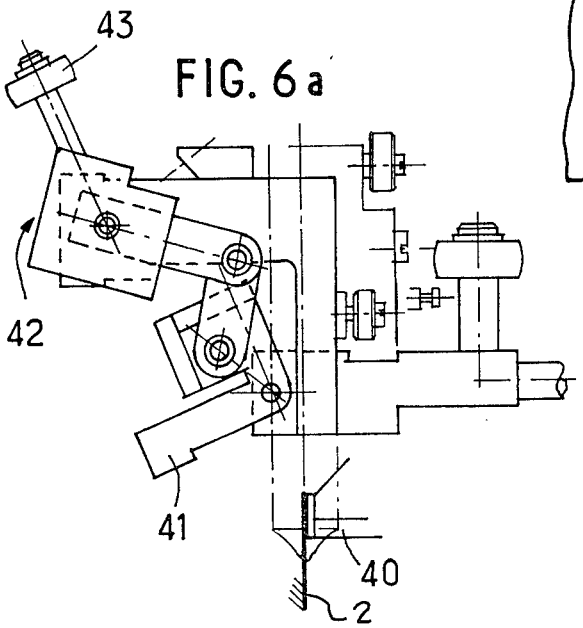
FIG. 6*a* shows an identical elevation of the feed claw system of FIG. 6, without a section, in an open position.
Figure 6E:
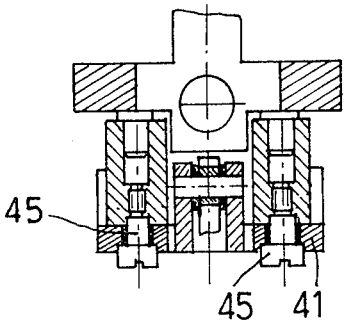
FIG. 6*e* is a sectional view taken along line E—E of FIG. 6*c;*

A pair of claws of the type is shown in FIG. 6. Each claw 39 comprises two jaws 40, 41 for clamping the string of containers therebetween. The jaw 40 is stationary, whereas the jaw 41 is articulated by a bevel 42 with which it is connected. Each of the claws 39 and 39' thus has two equilibirum positions:

an open position (FIG. 6*a*), that is to say when the two jaws 40 and 41 are spread apart,
the other, a closed position (FIG. 6), that is to say when the two jaws 40 and 41 are clamped against each other.

As shown in FIG. 6, the opening and the closing of each claw 39 and 39' is controlled via the bevel 42 by means of a wheel 43 acting as a cam to engage an opening ramp 52 and a closing ramp 53. The opening ramp 52 and the closing ramp 53 are mounted upon a stationary plate 65 of the container filling unit 5 and extend downwardly to engage the wheel 43 of each of the pair of claws 39 and 39', as rotated there past on the carousel 64, as shown in FIGS. 9. The movement for taking each container is therefore simple as it follows from the closure of the two jaws 40 and 41 of the same claw. A pair of conjugate claws 39, 39' are designed to hold a single container and are mounted upon the container filling unit 5 including a carriage 44 to follow each container throughout the filling and packaging process.

For this purpose, the two container walls also have to be spread apart in order to define a filling orifice. As the container is held at each of its two upper ends by one of the claws 39 and 39', the spacing between the claws 39 and 39' defines the opening of the container in cooperation with a spreading device which will be described below.

Figure 6B:
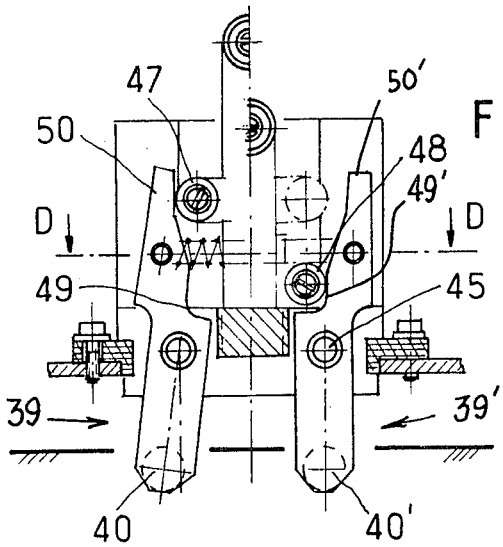
FIG. 6*b* is a sectional view taken along line B—B of FIG. 6 showing schematically two relative positions of the claws.
Figure 6D:
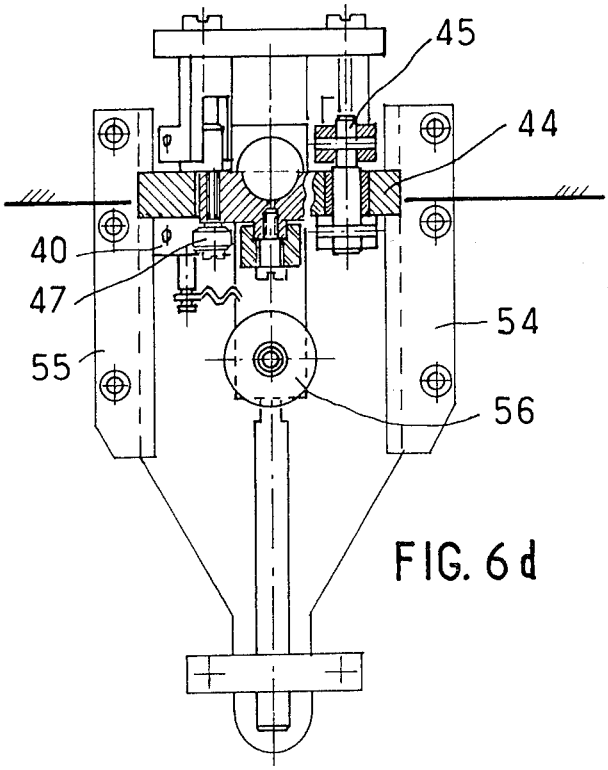
FIG. 6*d* is a sectional view taken along line D—D of FIG. 6*b;*
Figure 6F:
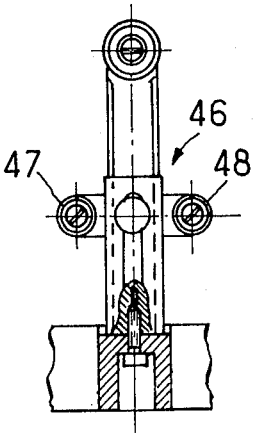
FIG. 6*f* is a detailed view of the claw control member shown in FIG. 6*b;*

The claw movement is shown more particularly in FIG. 6*b*. In the left-hand position, the claw 39, as well as the claw 39' not so illustrated are in a spread apart position for receiving a container. In the right-hand position, the claw 39' is pivoted about an axle 45 to a closed position with respect to the claw 39 not illustrated, and the pairs of jaws for each of the claws 39 and 39' are brought together to hold the film 2. This movement of the two claws 39, 39' of the same carriage 44 is controlled by a drive member 46 shown in FIG. 6*f*. The drive member 46 is actuated in a manner to be explained with a reciprocating upward and downward movement. During the downward movement, two symmetrically disposed wheels 47 and 48 travel along cam surfaces 49 and 49' which are shaped on the arms 50 and 50' integral with each of the jaws 40 and 40', respectively. The movement of the drive member 46 is also controlled by a cam which will be explained later on.

In this system, the two external movable jaws 41 and 41' of the same pair of claws are coupled with each other by means of a connecting arm 51 during their opening movement in order to receive the container. Similarly, the two jaws of one claw rotate cooperatively with each other about their axle 45. Each of the carriages 44 is mounted on the carousel-like container filling unit 5 upon which the various filling and packaging operations are carried out. It will be understood that, since the filling of each container necessitates shortening of the upper portion of the said container, a variation in rhythm takes place. These carriages 44 which are rotated on the container filling unit 5 can also be moved radially with respect to the vertical axis of the unit 5 on guides 54 and 55, and a wheel 56 traveling along a cam slope. This cam slope, as well as the two ramps 52 and 53 (see FIG. 6) and the ramp for guiding the member 46 are arranged on the fixed plate 65, shown in FIG. 9, to be disposed above the rotatively driven carousel 64.

As indicated above, the container walls are moved apart by the combination of two movements:

the movement of the two claws 39 and 39' towards each other, thus disposing the ends of the upper opening of the container towards each other as described above,
the spreading of each of the container walls on each side of the vertical plane of travel of the film 2 as will be described below.

This spreading is effected by a system of a pair of suction nozzles 57 and 58 mounted on the carousel 64 and operated concomitantly with the approach of the two claws 39 and 39' towards each other and is shown in FIGS. 7 and 7*a*. Two suction nozzles 57 and 58 are arranged symmetrically relative to each other, and effect a suction to each of the external surfaces of the container walls at an upper level corresponding to a non-welded portion of the container wall. This operation takes place very precisely between the two claws 39 and 39' of the device in FIG. 6. A device (not shown) is also fixed on the upper plate of the carousel 64 comes and spreads the two suction nozzles 57 and 58. The suction nozzle 58, which is supported by a carriage 59 capable of radial movement relative to the axis 72 of the carousel, is shown in FIG. 7*a*. The carriage 59 and nozzle 58 are moved reciprocally between a first together position as shown in FIG. 7*a* whereat suction is applied to the container wall, and a second, spaced position as shown in FIG. 7. The suction nozzle 58 is able to return reciprocally to its second, spaced position once the suction of the suction nozzle 58 has ceased.

The carousel 64 rotates in a fashion which is indexed by indexing devices as are well known in the art and is driven by a motor by means of gearing as shown in FIG. 9. The packaging or filling operation are also carried out about this carousel 64. In the filling operation, sterilized air is first blown into the container which is presented in the open position. This step is optional and actually depends on the operating conditions, since initial sterilization has already been carried out.

Figure 8A:
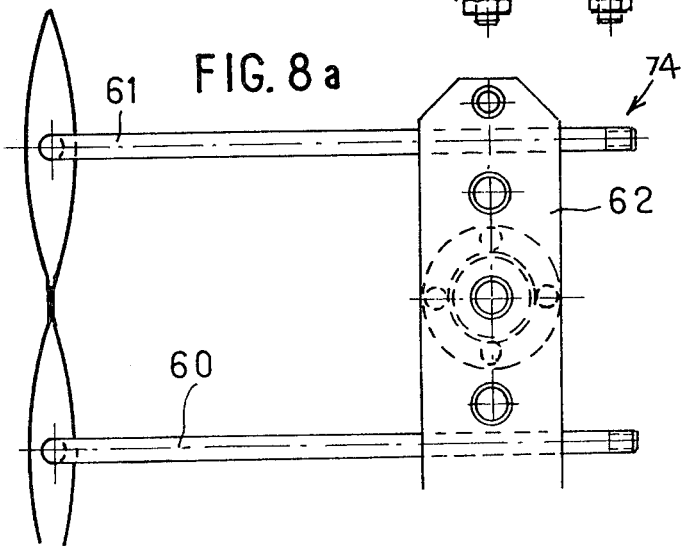
FIG. 8*a* is a plan view of the liquid injection station shown in FIG. 8.

A suitable liquid injection station 74 is described with reference to FIGS. 8 and 8*a*. The liquid injection station 74 comprises at least one injection cannula 60, but preferably comprises also a second cannula 61 for reasons connected with the problems of the flow of filtered and sterile air. These cannulae 60 and 61 are supported by an assembly plate 62 which can be lowered or raised to bring the cannulae 60 and 61 into the container opening under the action of a jack 63. The carousel 64 and the stationary upper plate 65 on which the various above-mentioned guide cams as well as the injection station 74 are arranged, are shown in FIG. 8. The containers are filled with a controlled quantity of liquid by a well known metering device (not shown).

The container is closed immediately after it is filled. After the filling operation and departure from the injection station 74 by the indexed rotational movement of the carousel 64, the two claws 39 and 39' are caused to move away from each other, thus applying tension to the two upper edges of the container and holding the upper edges together. Then, while each container is still held individually by the claws 39 and 39', the filling cavity is welded at the closing station 6.

According to the above-mentioned patents belonging to the applicants, the container handle could optionally also be filled with a liquid, with a gas, or again with a cold-setting fluid material. To effect this, the same procedure is adopted as for filling the main cavity of the container, except that a second container opening is provided at the top. The walls are spread by claws and suction nozzles, and a filling cannula is introduced.

The continuous string after leaving the closing station 6 is then cut into individual sachets or into strings of several units. These cutting devices (not shown) are well known in the art.

The structure described for the carousel 64 also allows a number of modifications. In fact, the length of the string is necessarily reduced during the filling operation. This is due, on the one hand, to the production of the opening by the movement of the two claws 39 supporting the same container towards each other and, on the other hand, to filling the container with a liquid with the result that the film 2 is no longer flat. For this reason, the path of the string of containers along the carousel 64 will not be circular, but it will assume an approximately spiral shape converging toward the axis 72 of the carousel 64. This result is obtained in practice by the carriages 44 which support the claws 39 and 39' and travel on slides 54, 55 due to the conjugate action of the wheel 56 cooperating with a cam path arranged on the stationary upper plate 65.

Moreover, the string of containers is held during and after the filling operation by rollers in order to reduce the traction at the level of the claws 39 and 39'.

Finally, this packaging apparatus will be disposed in a sterile super-pressurized atmosphere when filling containers with edible liquids in particular.

The drive of the carousel 64 and the translation of the film 2 is advantageously achieved by means of the same motor 66, this being of interest from the point of view of synchronization of operation. With reference to FIG. 9, the motor 66 rotatively drives the carousel 64 in indexed rotation. The motor 66 also imparts a reciprocating motion via the the connecting rod 37 to the feed claw assembly 70 described above. In particular, motor 66 coupled by a toothed wheel 67 meshing with a second toothed wheel 68, which is in turn connected with a plate 69 acting as a crank.

The packaging apparatus of this invention could provide identical results with an entirely linear structure of the various work stations. In this case, the injection and filling stations could also be movable stations which advance with the string and start again after operation if continuous work rather than intermittent work is desired.

Numerous changes may be made in the above-described apparatus and different embodiments of the invention may be made without departing from the spirit; therefore, it is intended that all matter contained in the foregoing description and the accompanying drawings shall be interpreted as illustrative and not in a limiting sense.

We claim:

1. Packaging apparatus for forming a connected series of containers from an elongated strip of film and for disposing materials in each of said containers, said apparatus comprising:

(a) a supply of the elongated strip of film;

(b) means for withdrawing the film from said supply and for advancing the film along a path;

(c) means disposed at a first station adjacent said path for operating upon and for forming the film into the series of connected containers;

(d) means disposed at a second station along said path downstream of said first station for injecting material at periodic intervals into a single one of the series of containers as it is brought one at a time to said second station, said injecting means comprising opening means for engaging the film that is brought to said second station and for effecting an opening in each container whereby said injecting means may inject materials into each container as it is disposed at said second station, whereby the length of the elongated strip is decreased;

(e) means for imparting a relatively stationary relationship between each container of the series and said material injecting means, thereby permitting the injection of materials by said material injecting means into each of said containers of the series; wherein said imparting means comprises a carousel, motor means for providing a rotational movement to said carousel, and said opening means comprises a plurality of holding means, each spaced at given intervals about the periphery of said carousel, each of said holding means for receiving and holding one of the containers of the series; and (f) strip length compensating means responsive to the advancement of the strip along said path for disposing the containers of the series closer together while being filled with material by said injecting means wherein said strip length compensating means comprises a plurality of positioning adjusting means, each coupled to a corresponding holding means and operative in response to the rotation of said carousel for disposing its corresponding holding means along a radial path towards the axis of said carousel, whereby successive containers of the strip are spaced closer together after they have been filled with material by said injecting means.

2. The packaging apparatus as claimed in claim 1, wherein each of said holding means comprises a pair of jaws for releasably holding one end of said container and means responsive to the rotational movement of said carousel for moving said jaws perpendicular to the plane of said film thereby closing said jaws of one of said holding means, whereby one of the containers is grasped at each end thereof by a corresponding holding means, and thereafter opening said jaws of each of said corresponding holding means, whereby the one container is released.

3. The packaging apparatus as claimed in claim 2, wherein each of said jaws of a pair is rotated about its own axle to permit movement of each jaw of said pair parallel to said plane of said film and towards and away form each jaw of an adjacent pair of jaws holding the other end of said container in response to the action of a drive member in an up and down movement, said drive member comprising two symmetrical rollers moving along a like pair of cams formed on one jaw of each of said adjacent holding means, the movement of said drive member being controlled by a cam mounted stationary with respect to said carousel.

4. The packaging apparatus as claimed in claim 3, wherein there is included a pair of suction nozzles disposed on opposing sides of the strip of film for separating each of the walls of each container in response to the movement of said pair of adjacent holding means towards each other.

5. The packaging apparatus as claimed in claim 1, wherein said imparting means comprises first and second flat jaws mounted for movement along said path, and there is provided means for coupling said first and second flat jaws to move in synchronism with the rotation of said carousel.

6. The packaging apparatus as claimed in claim 1, wherein said material injecting means is disposed stationary and said imparting means is disposed between said first and second stations for imparting an intermittent movement to the film whereby each container of the series is brought one at a time to said second station.

7. The packaging apparatus as claimed in claim 6, wherein said imparting means comprises first and second jaws disposed on either side of said path for engaging opposite surfaces of the strip of film and for intermittently engaging and moving the strip of film along said path.

8. The packaging apparatus as claimed in claim 1, wherein each of said holding means hold a corresponding container of the series at first and second ends thereof and is actuatable at the periodic intervals for bringing the first and second ends toward each other to thereby form an opening in the corresponding container.

9. The packaging apparatus as claimed in claim 1, wherein said motor means is operatively connected to said imparting means to insure the coordinated operation of said materials injecting means and said imparting means, whereby each of the containers of the series is brought to said second station at a time coordinated with the operation of said materials injecting means.

10. The packaging apparatus as claimed in claim 6, wherein said withdrawing means includes second means for imparting an intermittent movement to the elongated strip of film along said path.

11. The packaging apparatus as claimed in claim 10, wherein said second imparting means comprises a first roller for withdrawing the film from said supply, a second roller spaced from said first roller along said path, a brake operatively coupled to said second roller for imparting a braking motion thereto when not advanced by the film, a third roller disposed between said first and second rollers, and means for imparting an intermittent movement to said third roller to intermittently engage and to impart intermittent movement to the strip of film.

12. The packaging apparatus as claimed in claim 1, wherein said forming means imparts a generally U shape to the strip of film having opposed side portions and a bite portion.

13. The packaging apparatus as claimed in claim 12, wherein said forming means comprises a first set of rollers, each of said first set of rollers disposed on opposite sides of the strip of film for forming the strip of film into the U shape, projecting means disposed downstream of said first set of rollers along said path for engaging the bit portion and imparting thereto a fold, whereby the strip of film is formed into a substantially W shape, and a second set of rollers disposed along said path downstream of said projecting means for imparting creases to each edge of the W shaped strip of film.

* * * * *